United States Patent [19]

Shindelar

[11] Patent Number: 4,483,220

[45] Date of Patent: Nov. 20, 1984

[54] ADJUSTABLE SPANNER WRENCH

[75] Inventor: Aloysius C. Shindelar, Hudson, Iowa

[73] Assignee: Deere & Company, Moline, Ill.

[21] Appl. No.: 159,615

[22] Filed: Jun. 16, 1980

[51] Int. Cl.[3] ..... B25B 13/28

[52] U.S. Cl. ..... 81/100; 81/90 C

[58] Field of Search ..... 81/90 B, 90 C, 94, 100, 81/111, 118, 180 B

[56] References Cited

U.S. PATENT DOCUMENTS

| | | | |
|---|---|---|---|
| 1,184,989 | 5/1916 | Perkins | 81/100 |
| 1,425,845 | 8/1922 | Foster | 81/90 C |
| 2,504,418 | 4/1950 | Hotchkiss | 81/90 B X |
| 2,991,677 | 7/1961 | Savarin | 81/90 B X |
| 3,985,050 | 10/1976 | Lurie | 81/180 B X |

FOREIGN PATENT DOCUMENTS

| | | | |
|---|---|---|---|
| 1959238 | 6/1971 | Fed. Rep. of Germany | 81/90 C |

*Primary Examiner*—James G. Smith

[57] ABSTRACT

This invention relates to an adjustable spanner wrench for rotating a cylindrical rod guide cap having a plurality of circumferentially spaced apart openings. The adjustable spanner wrench includes an elongated handle with a first and a second arm member attached thereto. The first arm member is rigidly attached to one end of the handle while the second arm member is adjustably attached at a distal point from the first arm member. Secured to each of the arm members is a tool with a hardened flat tip. These tools are held in an oppositely aligned and parallel relationship by the first and second arm members and are designed to engage two of the oppositely aligned openings in the rod guide cap. The adjustable spanner wrench further includes adjusting means associated with at least one of the arm members for urging the first and second arm members together so that the two tools positively engage two of the openings in the rod guide cap.

3 Claims, 2 Drawing Figures

ADJUSTABLE SPANNER WRENCH

FIELD OF THE INVENTION

This invention relates to an adjustable spanner wrench and more particularly to an adjustable spanner wrench for rotating hydraulic cylinder rod guide caps.

BACKGROUND OF THE INVENTION

Various types of spanner wrenches are available today for loosening or tightening large or oversize objects. The typical spanner wrench has a projection or hook at one or both ends of the head for engaging with a corresponding device on the object to be turned. Such wrenches generally satisfy most applications but now and then a unique problem presents itself wherein a particular tool is needed. Such is the case for a rod guide cap which fits over the end of a hydraulic cylinder and physically retains the piston rod in position. These rod guide caps come in various sizes to fit the different diameter cylinders. Generally, the caps are three or more inches in diameter and are tightened down in place under a high torque force. This large torque force requires an equal or greater force to remove the caps, especially when the caps become rusted onto the hydraulic cylinders.

Due to the unacceptability of current spanner wrenches to turn rod guide caps, either due to slippage, breakage, or size limitations, a new specially designed adjustable spanner wrench has been invented.

The general object of this invention is to provide a new and improved adjustable spanner wrench. A more specific object of this invention is to provide an adjustable spanner wrench for rotating hydraulic cylinder rod guide caps.

Another object of this invention is to provide an adjustable spanner wrench which is both durable and inexpensive.

Still another object of this invention is to provide an adjustable spanner wrench with replaceable hardened tool tips.

A further object of this invention is to provide an adjustable spanner wrench designed for heavy duty use.

Other objects and advantages of the present invention will be more apparent from the following description and the drawings.

SUMMARY OF THE INVENTION

Briefly, this invention relates to an adjustable spanner wrench for rotating hydraulic cylinder rod guide caps. This adjustable spanner wrench comprises an elongated handle with first and second outwardly projecting arm members. The first arm member is rigidly attached to one end of the handle and supports a hardened tool. The second arm member is adjustably attached to the handle in a distal relationship to the first arm member and contains a plurality of adjusting holes. This second arm member also holds a hardened tool and is aligned in an inline and parallel relationship to the first arm member when positioned on a hydraulic cylinder. The two hardened tools, held by the first and second arm members, are designed to be inserted into openings, such as slots or holes, located circumferentially about the rod guide cap in a spaced apart configuration.

The adjustable spanner wrench further includes an adjusting means situated between the second arm member and the handle for urging the arm members together in a scissor-like arrangement so that the two hardened tools positively engage the rod guide openings. Such positive engagement is a necessity when one is trying to remove a rod guide cap after it has become rusted onto the end of a hydraulic cylinder.

DETAILED DESCRIPTION OF THE INVENTION

Figure 1:
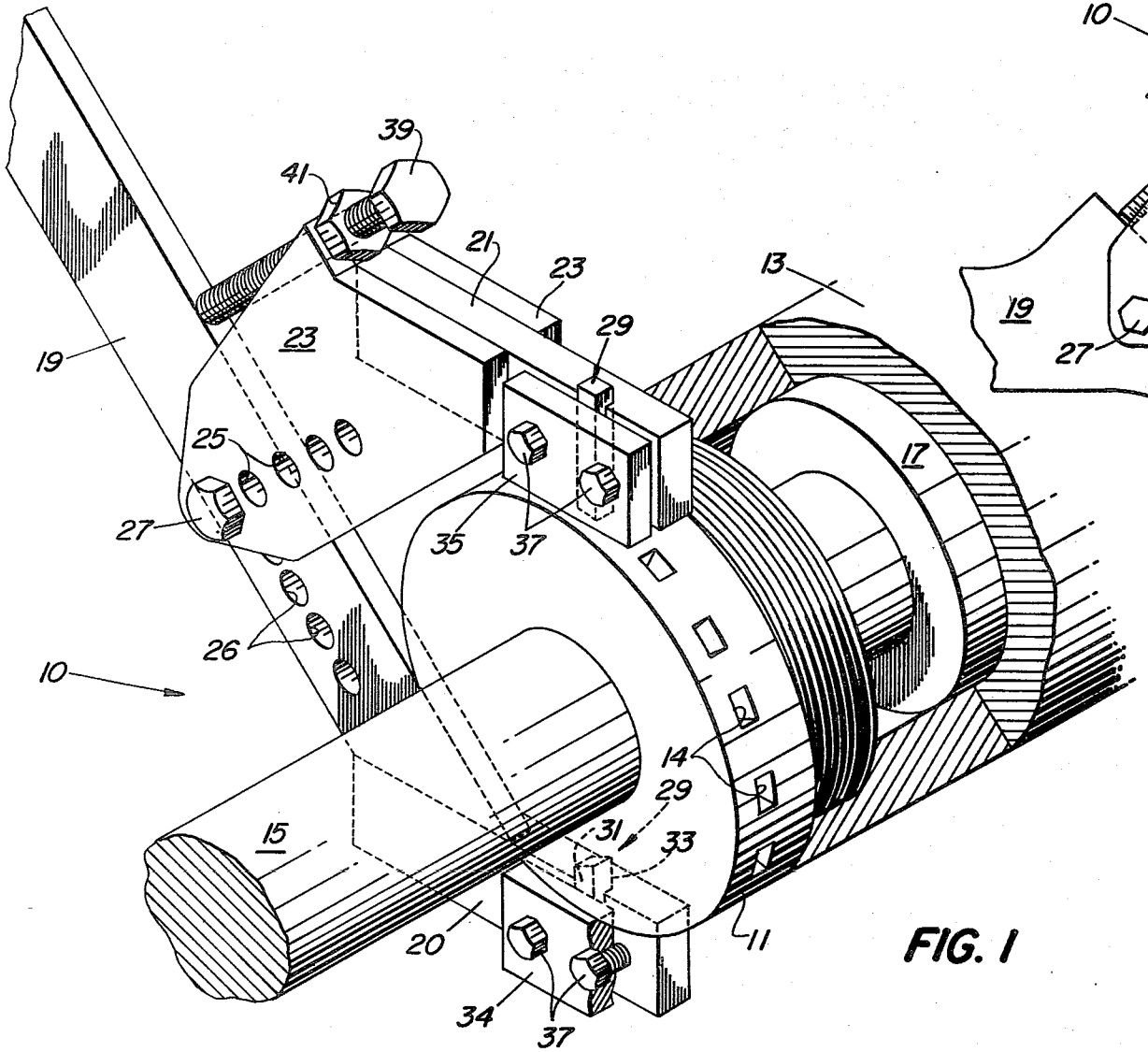
FIG. 1 is a perspective view of one embodiment of the adjustable spanner wrench attached to a hydraulic cylinder rod guide

Referring now to FIG. 1, an adjustable spanner wrench 10 is shown attached to a rod guide cap 11 which is screwed into the end of a hydraulic cylinder 13. The rod guide cap 11 provides a support means for a piston rod 15 which in turn is connected to a reciprocating hydraulic piston 17. A typical rod guide cap 11 is cylindrical in shape and is designed to attach to or mount over one end of the hydraulic cylinder 13. Large hex nuts, circular caps, and multi-sided plugs could all qualify as various configurations of rod guide caps 11. The rod guide cap 11 generally contains a plurality of circumferential openings 14, such as slots, grooves or holes arranged in a spaced apart configuration. These openings 14 are arranged so that each has an oppositely aligned opening, that is, a corresponding opening positioned 180 degrees in relation to it. The purpose of these openings 14 is to provide a means by which the adjustable spanner wrench 10 can securely grasp the rod guide cap 11.

The adjustable spanner wrench 10 is comprised of an elongated handle 19 having first and second attached arm members 20 and 21, respectively. The handle 19 extends outward away from the arm members 20 and 21 and can be angularly offset a number of degrees. This offset angle is useful once the adjustable spanner wrench 10 is fitted to a cap 11 and the wrench holder is limited as to what extent he can swing the handle 19.

The first arm member 20 is rigidly fastened to one end of the handle 19 and projects outward therefrom, preferably at an angle. The second arm member 21, which is adustably attached to the handle 19, is positioned distally away from the first arm member 20. This second arm member 21 lies in an inline and parallel relationship to the first arm member 20 once the adjustable spanner wrench 10 is secured to the hydraulic cylinder 13. This parallel arrangement is required so that the first and second arm members 20 and 21, respectively, can grasp the rod guide cap 11 and exert an equal force once the adjustable spanner wrench 10 is turned.

As shown in FIG. 1, the second arm member 21 is angularly attached to a support member 23 which in turn is adjustably attached to the handle 19. This support member 23 contains a plurality of bolt holes 25, one of which is positioned over one of a plurality of openings 26 located in the handle 19. A fastening means 27, such as a bolt, is positioned through both the handle 19 and the support member 23 and is held in place by a nut (not shown). It should be noted that alternative arrangements for attaching the support member 23 to the handle 19 will be apparent to those skilled in the fastening art.

Each of the first and second arm members 20 and 21, respectively, securely holds a tool 29. Each tool 29 is identical in shape and contains a hardened tip 31, preferably having a flat, smooth surface 33. The hardened tip 31 is designed to engage the rod guide cap 11 and fit into one of the openings 14. Within the opening 14, the hardened tip 31 should be positioned so that the flat, smooth surface 33 faces in the direction in which the rod guide cap 11 is to be turned. For example, if the rod guide cap 11 is to be rotated counterclockwise to be loosened, the flat, smooth surface 33 will face to the right, as viewed looking down on the tool 29 and from the back edge.

The exact method of securing each of the tools 29 to the arm members 20 and 21 can vary. In FIG. 1, holding plates 34 and 35 are fastened to the first and second arm members 20 and 21, respectively, by a plurality of machine screws 37.

The adjustable spanner wrench 10 further comprises adjusting means 39 associated with at least one of the arm members 20 or 21. The adjusting means 39 can force the first and second arm members 20 and 21, respectively, together so that each of the two tools 29 positively engage an oppositely aligned opening 14 in the rod guide cap 11. As shown in FIG. 1, the adjusting means 39 is a threaded bolt which passes through a threaded nut 41 securely fastened to the supporting member 23. This bolt 39 is designed to be threaded into or out of the nut 41 depending upon the diameter of the hydraulic cylinder 13. As the bolt 39 is threaded into the nut 41, it impinges on the handle 19 and forces support member 23 and the second arm member 21 to move toward the first arm member 20. This action causes both of the tools 29 on the first and second arm members 20 and 21, respectively, which are to positively engage the two oppositely aligned openings 14. The force exerted by the adjusting means 39 will both prevent the two tools 29 from backing out of the openings 14 as the rod guide cap 11 is rotated and also prevent the second arm member 21 from moving away from the first arm member 20. It should be noted that the adjusting means 39 can also be positioned between the first and second arm members 20 and 21, respectively, if desired.

Figure 2:
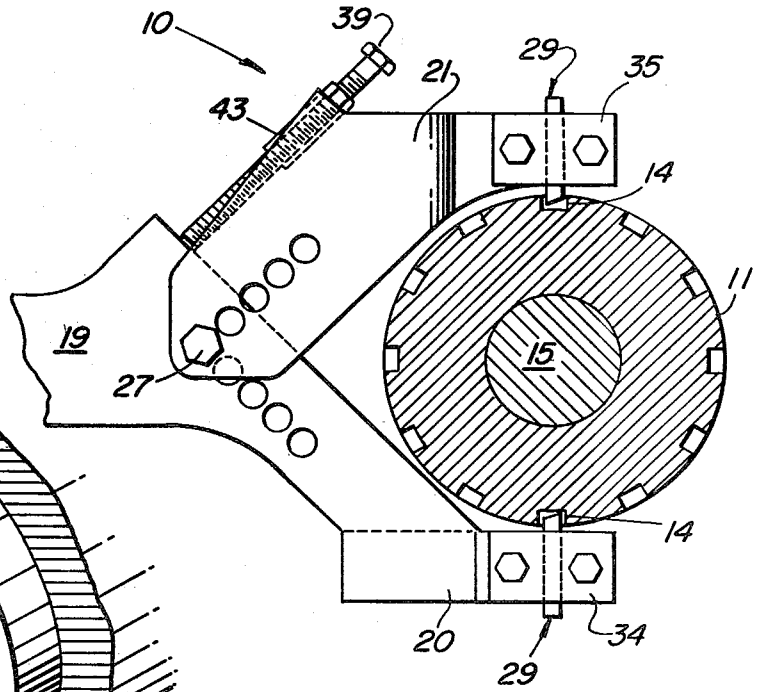
FIG. 2 is a view of an alternative embodiment of the adjustable spanner wrench.

Referring now to FIG. 2, an alternative embodiment of the adjustable spanner wrench 10 is shown with the two tools 29 positioned in two oppositely aligned openings 14. This embodiment differs in that the second arm member 21 is extended in a curvelike configuration so that no separate support member 23 is needed. The nut 41, shown in FIG. 1, is replaced by an internally threaded collar 43. Furthermore, the handle 19 is straight and in line with the center line of the rod guide cap 11, instead of being angularly offset.

An additional feature of this adjustable spanner wrench 10 is that it allows the first and second arm members 20 and 21, respectively, to hold the two tools 29 an equal distance from the pivot point through which bolt 27 passes. This means that each arm member 20 and 21 and each tool 29 will absorb an equal amount of the exerted force to turn the rod guide cap 11. This feature reduces the tendency to break off a tool 29 or to cause one of the tools 29 to slip out of its respective opening 14.

While the invention has been described in conjunction with two specific embodiments, it is to be understood that many other alternatives, modifications, and variations will be apparent to those skilled in the art in light of the aforegoing description. Accordingly, the invention is intended to embrace all such alternatives, modifications, and variations which fall within the spirit and scope of the appended claims.

I claim:

1. An adjustable spanner wrench for rotating a hydraulic cylinder rod guide cap which has a plurality of circumferentially spaced apart and oppositely aligned openings, said wrench comprising:

(a) an elongated handle containing a plurality of spaced apart openings;

(b) a first arm member rigidly attached to one end of said handle and projecting outward therefrom;

(c) a second arm member containing a plurality of spaced apart bolt holes adjustably positioned on said handle, distal from said first arm member, and projecting outwardly therefrom;

(d) a first and a second tool secured to said first and second arm members, respectively, in an inline and parallel relationship, each of said tools containing a hardened tip capable of positively engaging one of said openings in said rod guide cap;

(e) fastening means for attaching said second arm member to said handle, said fastening means including a bolt and nut, said bolt passing through one of said spaced apart openings in said handle and through one of said bolt holes in said second arm member such that said first and second tools are equal distance from said fastening means; and (f) adjusting means positioned between said second arm member and said handle for forcing said second arm member toward said first arm member so that said first and second tools positively engage two of said oppositely aligned openings in said rod guide cap and exert an equal force thereon.

2. The adjustable spanner wrench of claim 1 wherein said handle is angularly offset from the center line of said rod guide cap that when extended passes though the pivot point of said wrench.

3. An adjustable spanner wrench for rotating a hydraulic cylinder rod guide cap which has a plurality of circumferentially spaced apart and oppositely aligned openings, said wrench comprising:

(a) an elongated handle containing a plurality of spaced apart openings;

(b) a first arm member rigidly attached to an end of said handle and angularly projecting outward therefrom;

(c) a second curve shaped arm member containing a plurality of spaced apart bolt holes, said second arm member adjustably positioned on said handle distal from said first arm member;

(d) a first and a second tool secured to said first and second arm members, respectively, in an inline and parallel relationship, each of said tools containing a hardened tip capable of positively engaging said openings in said rod guide cap;

(e) a fastener passing through one of said spaced apart openings in said handle and through one of said bolt holes in said second arm member for attaching said second arm member to said handle so that said first and second tools are arranged in oppositely aligned openings in said rod guide cap; and (f) a rotatable adjusting bolt situated between said handle and said second arm member for forcing said second arm member toward said first arm member to insure that said first and second tools positively engage said openings in said rod guide cap.

* * * * *